United States Patent [19]

Benavidez

[11] 4,361,307

[45] Nov. 30, 1982

[54] METHOD AND APPARATUS FOR MOLDING CERAMIC WARE

[76] Inventor: Carl R. Benavidez, 11304 Trebol St., San Diego, Calif. 92126

[21] Appl. No.: 150,916

[22] Filed: May 19, 1980

Related U.S. Application Data

[63] Continuation-in-part of Ser. No. 928,502, Aug. 10, 1978, abandoned.

[51] Int. Cl.[3] ..... B41B 11/52

[52] U.S. Cl. ..... 249/118; 249/120; 249/137; 249/139; 249/161

[58] Field of Search ..... 249/120, 137, 139, 161, 249/118

[56] References Cited

U.S. PATENT DOCUMENTS

| | | | |
|---|---|---|---|
| 3,310,276 | 3/1967 | Bonney | 249/120 |
| 3,388,887 | 6/1968 | Frost | 249/120 |
| 4,046,272 | 9/1977 | Hayward | 249/137 |
| 4,080,129 | 3/1978 | Little | 249/137 |
| 4,111,254 | 9/1978 | Haglund | 249/137 |

*Primary Examiner*—John A. Parrish
*Attorney, Agent, or Firm*—Brown & Martin

[57] ABSTRACT

A method and apparatus for molding ceramic ware includes a support table having a horizontal axis of rotation with a plurality of molds attached to opposed surfaces of the table for orientation in the vertical upright and vertical inverted positions. A fluid molding material is poured into the mold when in the open upright position and is permitted to set up to the extent of forming a shell and then inverted to pour the remaining molding material from the mold, while molds on the opposed surface are disposed in the upright position for receiving mold material.

5 Claims, 5 Drawing Figures

METHOD AND APPARATUS FOR MOLDING CERAMIC WARE

REFERENCE TO RELATED APPLICATIONS

This application is a Continuation-in-part of my copending application Ser. No. 928,502, filed Aug. 10, 1978 now abandoned.

BACKGROUND OF THE INVENTION

The present invention relates to the molding of ceramic ware and pertains particularly to method and apparatus for high production molding.

Many ceramic articles are molded in two piece molds having an upwardly disposed opening into which a very fluid molding or casting material, such as clay or slip, is poured. The molds are generally open cavity two piece molds such that the molds may be taken apart to remove the articles from the mold.

The molding material is poured into the cavity of the mold and permitted to set for a predetermined period of time. The molds are such that moisture is absorbed from the molding material into the surface of the mold at the surface of the article such that a shell of molded material is formed within the cavity of the mold. The casting material begins to set up from the surface of the mold inward to the center of the cavity. This forms a thin shell of material which dries prior to the remaining material.

The customary procedure is to permit the mold to sit for a predetermined period of time, thereby formimg an outer shell and then pouring the remaining material from the mold by hand into containers. The mold is then permitted to sit for another period of time, after which it may be opened and the cast figure removed and further processed, such as by coating, curing, and/or baking.

This procedure is carried out by hand and is time consuming and slow. It also requires a great amount of strength for handling large molds which can become quite heavy when filled.

It is therefore desirable that some means be available which provides for easy and rapid handling of the molding process.

SUMMARY AND OBJECTS OF THE INVENTION

It is therefore the primary object of the present invention to overcome the above problems of the prior art.

Another object of the invention is to provide an apparatus for the quick and easy filling and emptying of ceramic casting molds.

A still further object of the invention is to provide an improved method of quickly and efficiently handling ceramic casting molds during the filling and emptying process.

In accordance with the primary aspect of the present invention, a support member that is rotatable about a horizontal axis is provided for supporting a plurality of casting molds such that the casting molds may be held in the vertical upright and vertical inverted positions. The molds can then be rotated to the upright position for filling and supported in that position for forming of the casting and then rotated to the inverted position for emptying the casting material from the mold.

The method in accordance with the invention is the provision of means for supporting a plurality of casting molds in vertical upright and inverted positions, supporting a plurality of molds in the vertical upright position, filling the molds with a casting material, permitting the material to partially set, rotating the table to provide the molds in the vertical inverted position for emptying the excess mold material from the casting mold.

BRIEF DESCRIPTION OF THE DRAWING

The above and other objects and advantages of the present invention will become apparent from the following description when read in conjunction with the drawings, wherein.

DETAILED DESCRIPTION OF A PREFERRED EMBODIMENT

Figure 1:
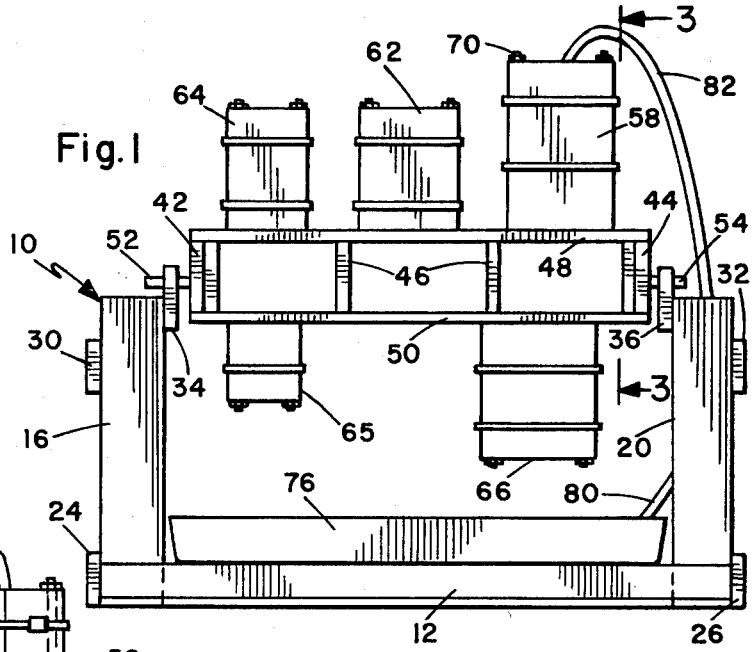
FIG. 1 is a side elevation view of the apparatus with molds attached.

Turning now to the drawings, there is illustrated in FIG. 1, an apparatus in accordance with the present invention. The apparatus, designated generally by the numeral 10, includes a base or frame member which may be constructed of any suitable material, and includes a pair of substantially parallel side rails 12 and 14 connected at their ends to generally upwardly extending support members 16, 18, 20 and 22. A pair of end rail members 24 and 26 secure the upwardly extending support members together at the base and may be secured to the ends of the base members 12 and 14. The upwardly extending members are secuted together at the top by means of a pair of brace members 30 and 32. A pair of journal brackets 34 and 36 are secured to the upper ends of the upwardly extending support members and each include a journal slot 38 and 40 respectively.

A support member or table of a generally rectangular configuration as in the illustrated configuration includes a plurality of cross frame members including a pair of end frame members 42 and 44 with intermediate cross members 46. These cross members are disposed between and secured, such as by nails, bolts, screws or the like, to a plurality of planks or boards 48 defining an upper surface and planks or boards 50 defining a lower support surface. These upper and lower or opposed support surfaces being spaced apart provide for ease of attachment of molds to the support structure. The apparatus can, of course, be constructed of any suitable material.

A pair of journal pins 52 and 54 are secured to the end members and are detachably or removably positioned within the journal slots 38 and 40. With this construction, the support table or a plurality of support tables may be utilized with a single base support structure. A support table is simply lifted off the base support structure and another one put in its place. This feature and the importance thereof will be discussed more fully later. The table is thus capable of rotation about a horizontal axis thus presenting either one of the table support surfaces 48 or 50 upward or downward and thereby supporting a mold or plurality of molds in the vertically oriented upper upright or inverted positions as will be described. An indexing pin 56 extends through bores in brackets 36 and in the end member 44 of the table or support frame for holding the table in the particular inverted position.

Figure 2:
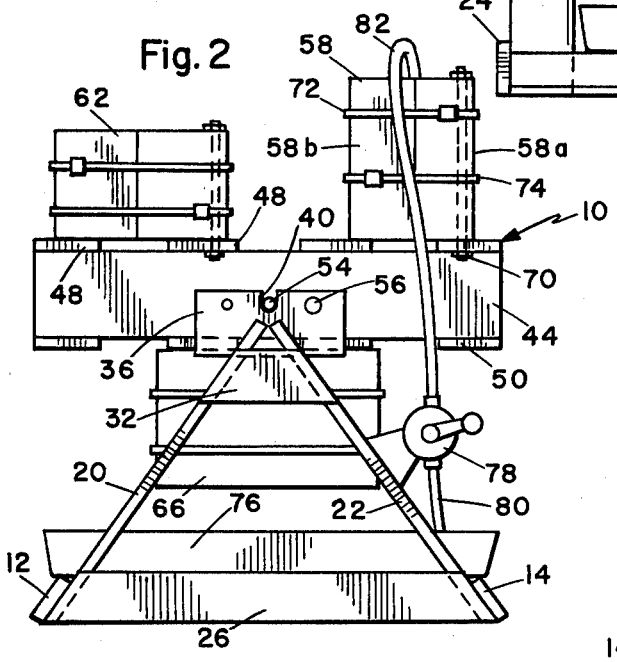
FIG. 2 is an end view of the apparatus.
Figure 3:
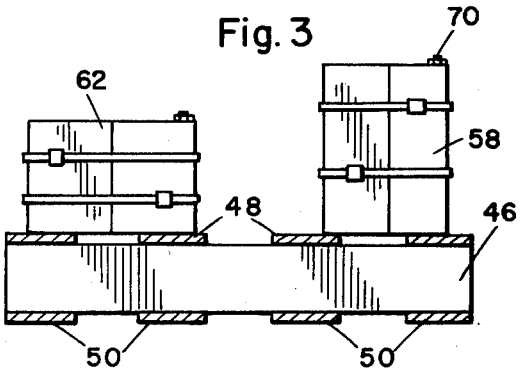
FIG. 3 is a sectional view taken on line 3—3 of FIG. 1.
Figure 4:
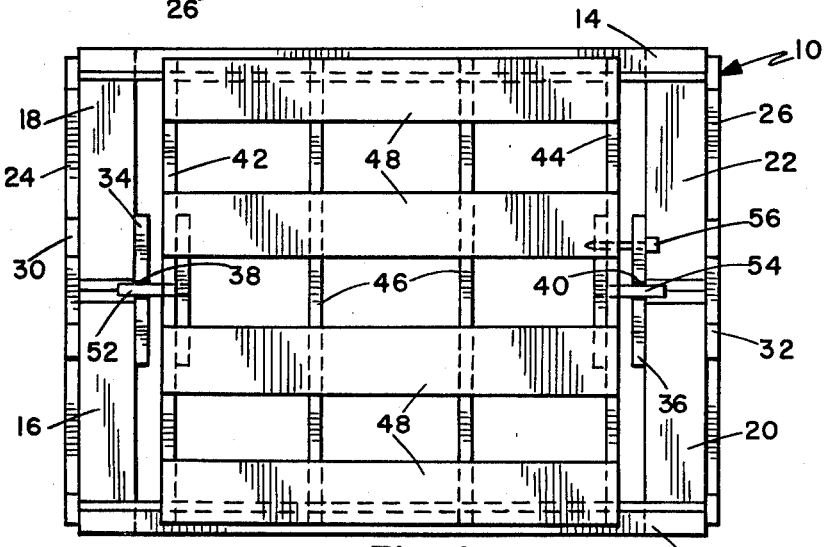
FIG. 4 is a top plan view of the apparatus, without molds.

A plurality of casting molds of conventional construction, for example, are mounted on the table as shown in FIGS. 1 through 3. More specifically, as seen in FIG. 1, a plurality of molds 58, 62 and 64 are secured to the upper side of the support table with a further plurality of molds 66 and 68 secured to the underside of the table. The molds in the upper side are now in their vertical upright position such that a casting material or slurry may be poured into the mold to begin to set up. The molds 66 and 68 are in the inverted position with the excess casting material emptied therefrom with the molds permitted to further set before the cast articles are removed from the molds.

Figure 5:
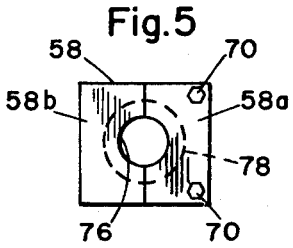
FIG. 5 is a top plan view of a typical mold showing bolt locations for attachment to the support apparatus.

Looking more closely at a pair of molds, for example, molds 58 and 62 are illustrated in FIG. 2 as being two part molds. Looking more closely at mold 58, for example, the mold consists of a part 58*a* and a part 58*b*. The part 58*a* is stationary or secured to the table by means of elongated bolts 70. One or more bolts may be used to secure the half of the mold to the table. The bolt is extended through portions of the mold to avoid the mold cavity. The other half of the mold 58*b* is secured to the first half by the securing straps 72 and 74, which normally secure the two halves of the mold together. These are preferably quick release straps of a well known type which permit the mold to be quickly opened and the contents thereof removed. As more specifically shown in FIG. 5, for example, the mold includes an opening 76 in the top thereof. This opening opens into a mold cavity, a portion of the extent of which is shown at 78 by broken lines.

A large open top reservoir or pan 76 is provided to catch the fluid material poured from the molds. This material can then be used again by pumping it such as by a pump 78 via a suction line 80 and a supply line 82 to fill the upright molds.

With the present invention, a plurality of molds either of the same type or different types, may be utilized on the table. For high production items, for example, all of the molds can be identical such that a plurality of the same article is turned out each time the table is inverted. Thus, with this arrangement, the individual separate handling of each separate mold is eliminated, thus making high production of casting of ceramic parts or articles possible.

The method of the invention is carried in a sequence of steps by first selecting a rotatable support frame that is rotatable about a horizontal axis and mounting it for such rotation. A plurality of casting molds are secured to at least one side of the support table. Thereafter, the molds are filled with a casting material such as by pumping from reservoir 76 with the molds in the upright vertical position. After a predetermined period of time when a portion of the casting material has set up, the excess casting material is poured from the mold into a reservoir by inverting the table or support. After the excess material has been removed, and the support table rotated back to present the mold in the upright position, the mold is allowed to set for a predetermined period of time to further cure or set up the cast article. Thereafter, the mold is opened and the article removed. The mold may then be closed and the sequence repeated. With molds on both sides of the support structure or table, the emptying of one set of molds presents the other set of molds into the upright position for receiving casting material.

While the present invention has been illustrated and described by means of a specific embodiment, it is to be understood that numerous changes and modifications may be made in the invention without departing from the spirit and scope of the invention as defined in the appended claims.

Having described my invention, I now claim:

1. An apparatus for pivotally supporting and inverting multiple molds for high production casting of ceramic articles, comprising:

a base member having a pair of spaced apart support members extending upward therefrom, a support platform having oppositely directed support faces pivotally mounted on said support members for pivoting at least 180° about a horizontal axis for presenting said support faces in a selected one of a vertically upright or inverted position, a first plurality of open top molds detachably secured to one face of said support platform and opening in one direction for pivoting therewith between an upright position for filling with liquid casting material and an inverted position for pouring said liquid casting material therefrom, and, a second plurality of open top molds detachably mounted on the other face of said platform and opening in the opposite direction so that said molds on said one side are inverted for pouring liquid casting material therefrom when molds on the other side are upright for filling with liquid casting material.

2. The apparatus of claim 1 wherein said molds are multiple part molds, one part of the mold being detachably secured to the support platform and the other part being detachably secured to the one part.

3. The apparatus of calim 1, wherein said base member includes a pair of spaced apart upwardly extending members, each having journal means at the uppermost part thereof, said support platform comprises a flat generally rectangular platform having a pair of cylindrical support pins rotatably journaled in said journal means.

4. The apparatus of claim 2 including a reservoir disposed beneath said support platform for receiving liquid casting material poured from said molds.

5. The apparatus of claim 4 including a pump for pumping liquid casting material from said reservoir into said molds when said molds are in the upright position.

* * * * *